US005521458A

United States Patent [19]

Kulik, Jr.

[11] Patent Number: 5,521,458

[45] Date of Patent: May 28, 1996

[54] ELECTRIC DISCHARGE LAMP ASSEMBLY

[75] Inventor: Joseph S. Kulik, Jr., Allenstown, N.H.

[73] Assignee: Osram Sylvania Inc., Danvers, Mass.

[21] Appl. No.: 428,931

[22] Filed: Apr. 25, 1995

[51] Int. Cl.[6] ..... H01J 61/34

[52] U.S. Cl. ..... 313/25; 313/634

[58] Field of Search ..... 313/25, 634, 573, 313/238, 269, 292

[56] References Cited

U.S. PATENT DOCUMENTS

| | | | |
|---|---|---|---|
| 2,966,600 | 12/1960 | Strauss | 313/25 |
| 3,409,790 | 11/1968 | Gottschalk | 313/292 X |
| 5,109,183 | 4/1992 | Robertson et al. | 313/634 X |
| 5,136,204 | 8/1992 | Muzarolla et al. | 313/25 |
| 5,252,885 | 10/1993 | Muzarolla et al. | 313/25 |
| 5,270,608 | 12/1995 | Williamson et al. | 313/25 |
| 5,466,981 | 11/1995 | Fuields et al. | 313/25 X |

FOREIGN PATENT DOCUMENTS

| | | | |
|---|---|---|---|
| 2034107 | 5/1980 | United Kingdom | 313/25 |

*Primary Examiner*—Sandra L. O'Shea
*Assistant Examiner*—Ashok Patel
*Attorney, Agent, or Firm*—W. H. McNeill

[57] ABSTRACT

An electric lamp includes a sealed lamp envelope including a dome region having an inward projection and a neck region sealed to a lamp stem. A lamp subassembly is located within the lamp envelope and includes an arc tube for generating light when electrical energy is applied thereto. A generally cylindrical, light-transmissive shroud is disposed about the arc tube. A frame includes a single support rod extends between the dome and neck regions of the lamp envelope along one side only of the subassembly, and a dome end of the frame engages the inward projection of the lamp envelope. A mounting structure is provided for attaching the arc tube and shroud to the frame. A bulb spacer is provided having first and second segments bearing against an inside surface of the lamp envelope in the neck region for positioning the frame relative to the lamp envelope, and also having a third segment joining the first and second segments, the third segment being spaced away from the inside surface of the lamp envelope. The frame is attached to the third segment. Electrical leads couple electrical energy through the lamp stem to the arc tube. The electrical leads and the lamp stem are electrically isolated from the frame, and the lamp subassembly is mechanically supported within the lamp envelope solely by the dome end of the frame, the bulb spacer and the leads.

2 Claims, 4 Drawing Sheets

ELECTRIC DISCHARGE LAMP ASSEMBLY

TECHNICAL FIELD

This invention relates to electric discharge lamps such as metal halide lamps and, more particularly, such lamps having improve structures for mounting an arc tube and a shroud within a lamp envelope.

BACKGROUND ART

Metal halide arc discharge lamps are frequently employed in commercial usage because of their high luminous efficacy and long life. A typical meal halide arc discharge lamp includes a quartz of fused silica arc tube that is hermetically sealed within a borosilicate glass lamp envelope. The arc tube, itself hermetically sealed, has tungsten electrodes attached into opposite ends and contains a fill comprising an arc generating and sustaining medium which can include mercury, metal halide additives and a rare gas. In some cases, particularly in high wattage lamps, the lamp envelope is filled with nitrogen or another inert gas at less than atmospheric pressure. In other cases, particularly in low wattage lamps, the lamp envelope is evacuated.

It has been found desirable to provide metal halide arc discharge lamps with a shroud which comprises a generally cylindrical, light transmissive member, such as quartz, that is able to withstand high operating temperatures. The arc tube and the shroud are coaxially mounted within the lamp envelope, with the arc tube located within the shroud. Preferably, the shroud is a tube that is open at both ends. In some cases, the shroud is open at one end and has a domed configuration on the other end. The shroud has several beneficial effects on lamp operation, which are known to those skilled in the art.

Sodium is an important constituent in most high intensity metal halide arc discharge lamps, usually in the form of sodium iodide or sodium bromide. Sodium is used to improve the efficacy and color rendering properties of metal halide lamps. It has long been recognized that arc tubes containing sodium lose sodium during lamp operation. Sodium is lost by the movement or migration of sodium ions through the arc tube wall. The iodide originally present in a metal halide lamp as sodium iodide is freed by the loss of the sodium and the iodide combines with mercury in the arc tube to form mercury iodide. Mercury iodide leads to increased reignition voltages, thereby causing starting and lamp maintenance problems.

A number of designs have been proposed in the prior art for reducing sodium migration from metal halide arc discharge, these designs being described in U.S. Pat. No, 5,270,608, which is hereby incorporated be reference, and which itself provided a technique for mounting the arc tube and its associated shroud within an outer envelope. The latter design employed a bulb spacer which solved the sodium migration problem and support problem; however, it, in turn, contributed to a problem known as a stuck seal, wherein the outer envelope sealed to the stem glass in an inappropriate manner. When a stuck seal occurs, it is an automatic rejection of the lamp.

DISCLOSURE OF THE INVENTION

It is, therefore, an object of the invention to obviate the disadvantages of the prior art.

It is another object of the invention to enhance the operation of discharge lamps and to reduce the scrap produced during manufacture.

These objects are accomplished, in one aspect of the invention, by an electric lamp which comprises a sealed lamp envelope including a dome region having an inward projection and a neck region sealed to a lamp stem. A lamp subassembly is located within the lamp envelope. The lamp subassembly includes an arc tube for generating light when electrical energy is applied thereto, and has a generally cylindrical, light-transmissive shroud disposed about the arc tube. A frame comprising a single support rod extends between the dome and neck regions of the lamp envelope along one side only of the subassembly. A dome end of the frame engages the inward projection of the lamp envelope. Means are provided for attaching the arc tube and the shroud to the frame. A bulb spacer has first and second segments bearing against an inside surface of the lamp envelope in the neck region for positioning the frame relative to the lamp envelope, and has a third segment joining the first and second segments, the third segment being spaced away from the inside surface of the lamp envelope. The frame is attached to the third segment. Electrical leads for coupling electrical energy through the lamp stem to the arc tube completes the lamp. The electrical leads and the lamp stem are electrically isolated from the frame, and the lamp subassembly is mechanically supported within the lamp envelope solely by the dome end of said frame, the bulb spacer and the leads.

By spacing the third segment away from the inside surface of the envelope and attaching the frame to it, the pressure point that existed in the prior art version is eliminated and the problem of the stuck seals is cured.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
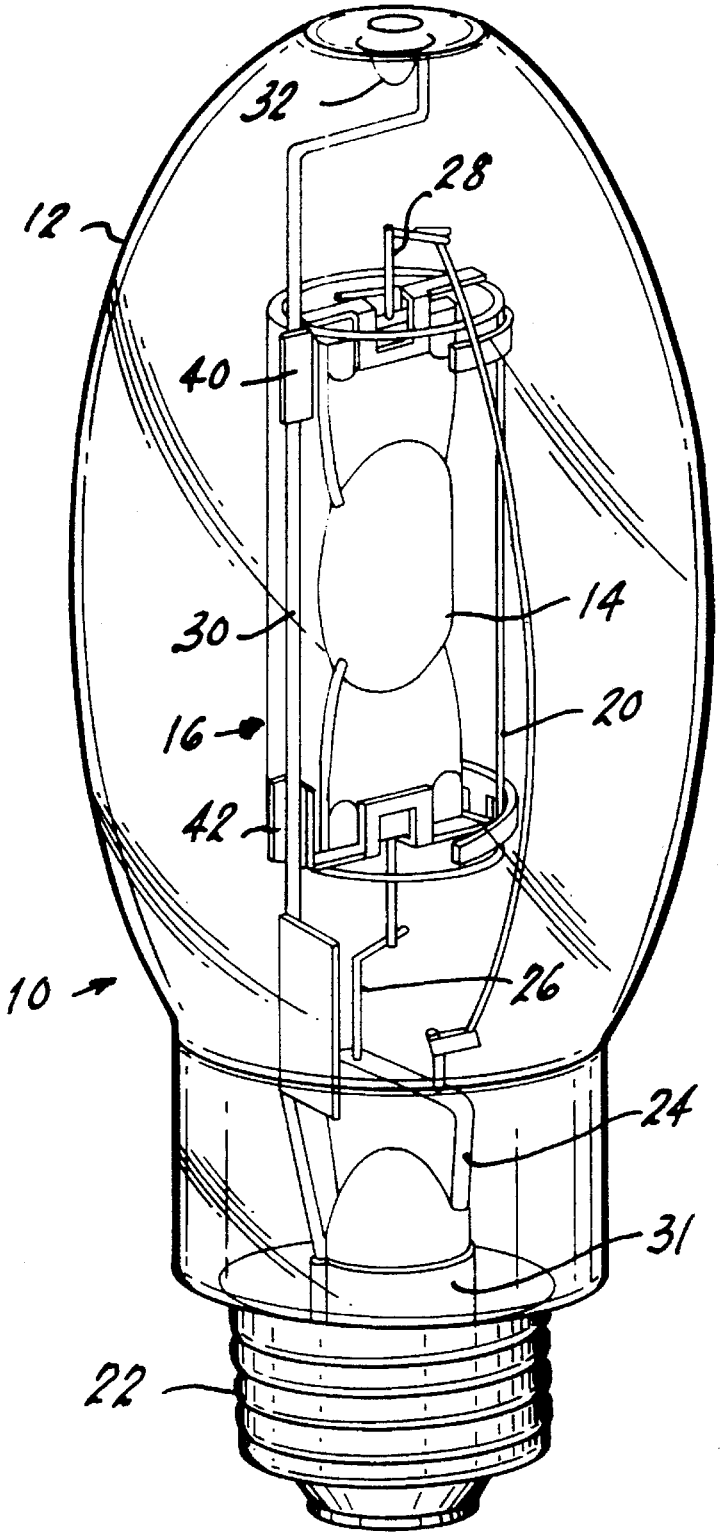
FIG. 1 PRIOR ART
FIG. 1 is a perspective view of a prior an lamp.

Referring now to the drawings with greater particularity, there is shown in FIG. 1 a prior art lamp 10 including a lamp envelope 12 and an arc tube 14 mounted therewithin by a mounting means 16. The arc tube 14 is positioned within a shroud 20. The shroud 20 is supported within the lamp 10 by mounting means 16. Electrical energy is coupled to the arc tube 14 through a base 22, a lamp stem 24 and electrical leads 26 and 28. The arc tube can be that of a metal halide lamp. The shroud 20 comprises a cylindrical tube of light transmissive material such as quartz or other suitable material.

The mounting means 16 supports both the arc tube 14 and the shroud 20 within the lamp envelope 12. The mounting means 16 includes a metal support rod 30 attached to lamp stem 24 by a strap 31. The support 30 engages an inward projection 32 in the upper end of the lamp envelope 12. The support rod 30 in its central portion is parallel to a central axis of arc tube 14 and shroud 20. The mounting means 16, further includes an upper clip 40 and a lower clip 42 which secure both arc tube and shroud to support rod 30. The clips 40 and 42 are attached to support rod 30, preferably by welding.

Figure 2:
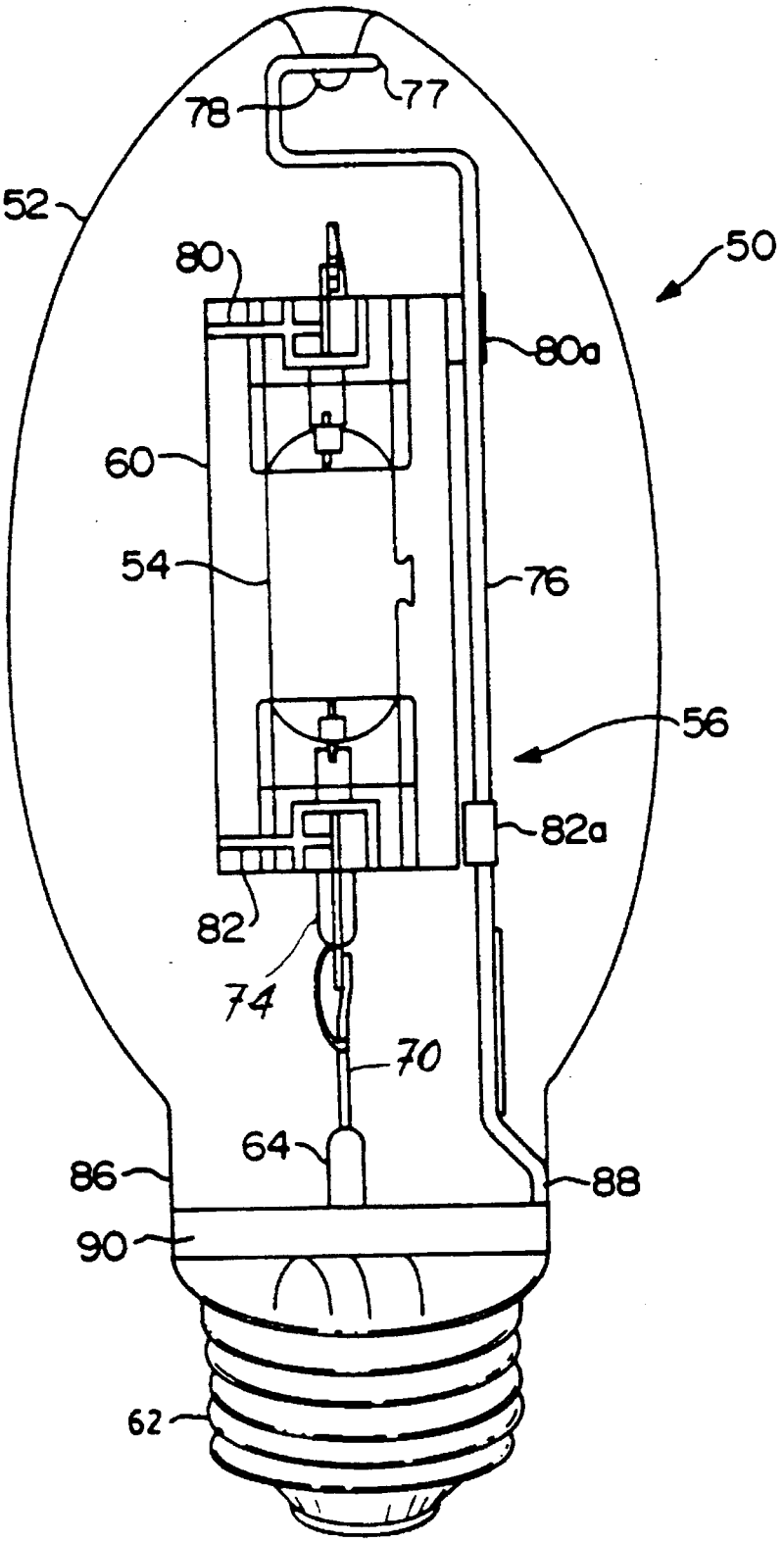
FIG. 2 PRIOR ART
FIG. 2 is perspective view of a second prior art lamp.

A second prior art lamp is illustrated in FIG. 2 wherein the lamp 50 includes a lamp envelope 52 and an arc tube 54 mounted therein by mounting structure 56. The arc tube 54 is positioned within a shroud 60 which, in turn, is supported within the lamp envelope 52 by the mounting structure 56.

Electrical energy is coupled to arc tube 54 through a base 62 and a lamp stem 64. The lamp stem 64 includes a flared portion that is sealed to lamp envelope 52. Electrical inleads 66 and 68 are sealed into lamp stem 64. Inlead 68 is electrically connected to one electrode of arc tube 54 by a conductor 70, and inlead 66 is electrically connected to the other electrode of arc tube 54 by conductor 72. A starting device, such as a glow bottle 74, is connected to conductor 70.

The mounting structure 56 mechanically supports both the arc tube 54 and the shroud 60 within the lamp envelope 52. The mounting structure 56 secures arc tube 54 and shroud 60 in fixed position so that they cannot move axially or laterally relative to the lamp envelope 52 during shipping and handling or during operation. The mounting structure 56 includes a frame comprising a metal support rod 76 having a central portion that is parallel to a central axis of arc tube 54 and shroud 60. A dome end 77 of support rod 76 engages a projection 78 in the dome end of lamp envelope 52. The projection 78 extends inwardly from the dome end of lamp envelope 52 and is located on a central axis thereof. The dome end 77 of rod 76 is formed into a generally circular shape that is dimensioned for receiving projection 78.

The mounting structure 56 further includes an upper clip 80 and a lower clip 82 which secure both arc tube 54 and shroud 60 to support rod 76. The clips 80 and 82 include tabs 80*a* and 82*a*, respectively, which are attached to support rod 76, preferably by welding. Further details regarding clips 80 and 82 are provided in the aforementioned U.S. Pat. No. 5,136,204, which is hereby incorporated by reference. Other clip and strap arrangements for attaching an arc tube and a shroud are known to those skilled in the art.

The envelope 52 includes a neck region 86 having a smaller diameter than the main portion thereof. A neck end 88 of support rod 76 is attached to a bulb spacer 90 which comprises a strip of resilient, heat resistant material that bears against the inside surface of envelope 52 in neck region 86 and retains the lower end of support rod 76 in a fixed position. A portion of support rod 76 adjacent to neck end 88 is typically angled outwardly toward envelope 52 for attachment to bulb spacer 90. The bulb spacer 90 positions support rod 76 such that arc tube 54 and shroud 60 are centered within lamp envelope 52.

Figure 3:
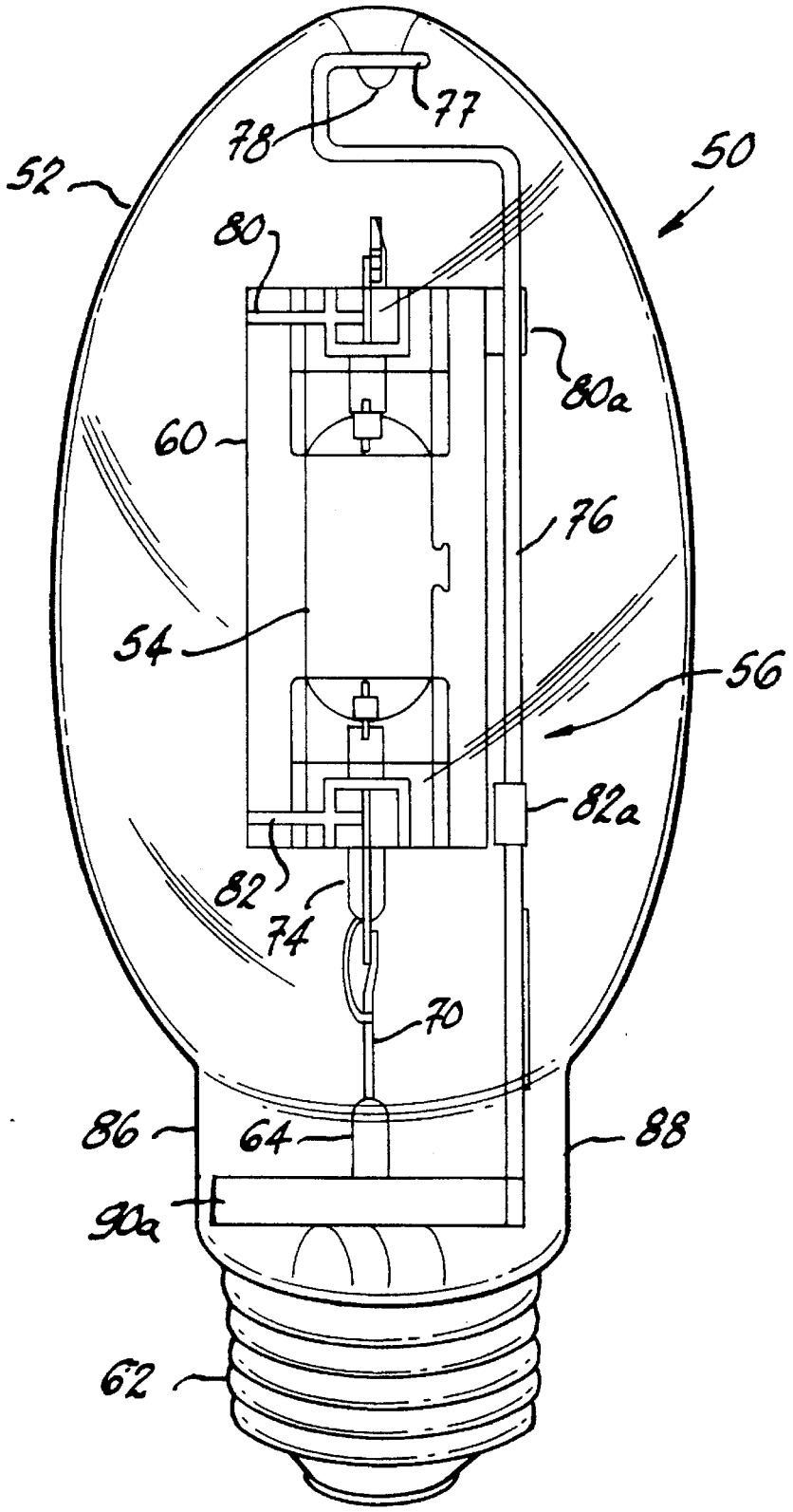
FIG. 3 is a perspective view of a lamp employing an embodiment of the invention.
Figure 4:
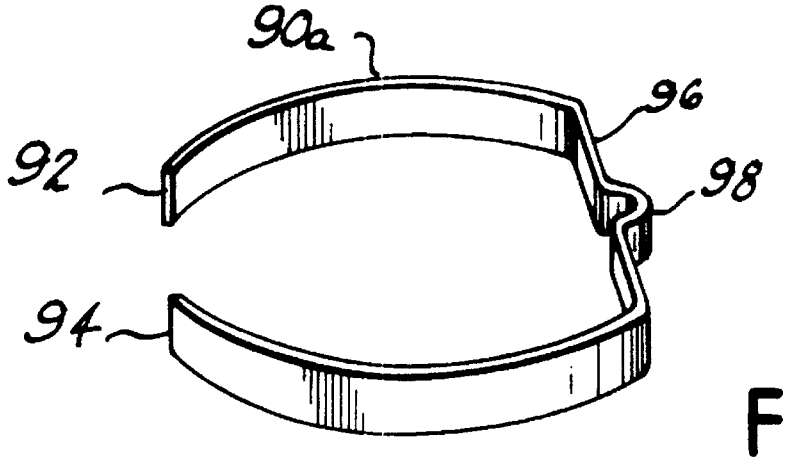
FIG. 4 is a perspective view of an embodiment of the invention isolated from a lamp.
Figure 5:
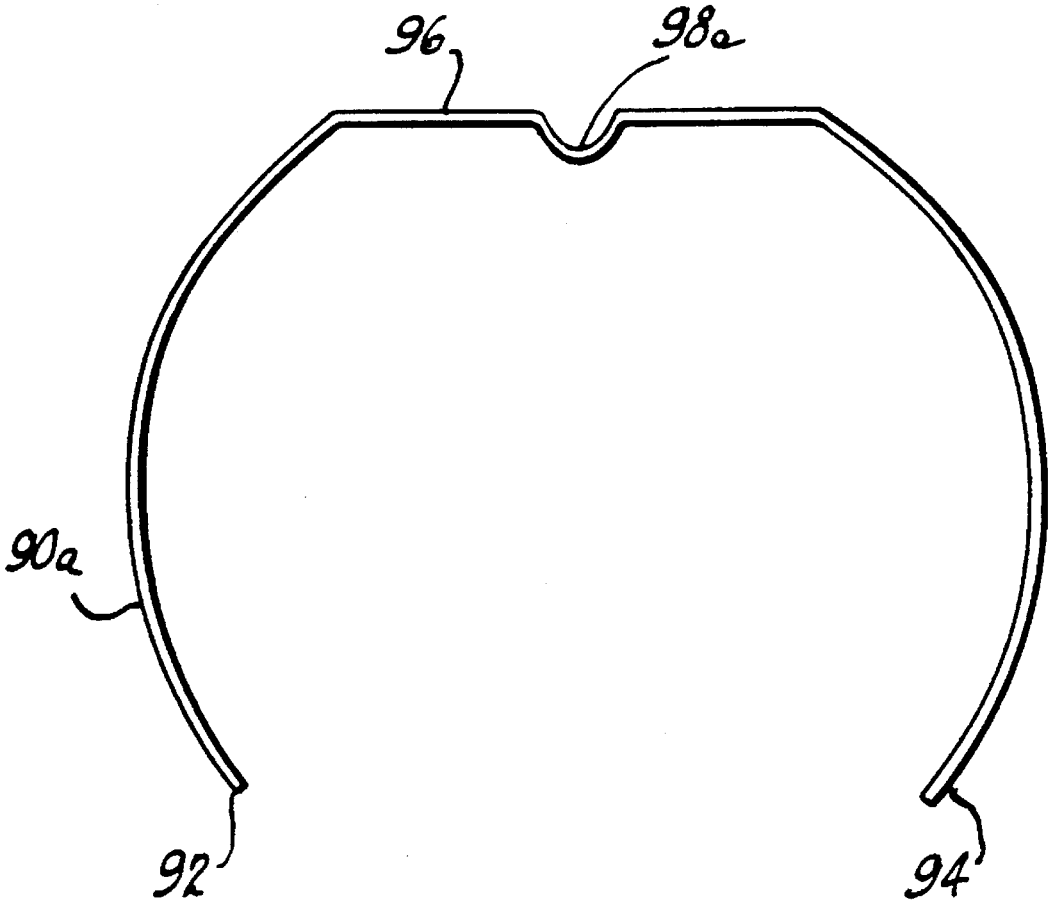
FIG. 5 is a view similar to FIG. 4 of an alternate embodiment of the invention.

A preferred embodiment of the invention is shown in FIGS. 3 and 4. A strip of resilient, spring-like material, such as stainless steel, is formed into a generally D shaped bulb spacer 90*a*. Preferably, the strip has a width in the range of about 0.125 inch to 0.250 inch and a thickness of about 0.010 to about 0.020 inches when stainless steel is used. The bulb spacer 90*a* has first and second segments 92 and 94 bearing against an inside surface of envelope 52 in the neck region for positioning the frame relative to the lamp envelope. A third segment 96 joins the first and second segments, with the third segment being spaced away from the inside surface of said lamp envelope. The frame, that is, rod 76 is attached to the third segment via welding at dimple 98. The dimple can extend inwardly toward the center of the lamp as shown in FIG. 5 at 98*a*, or outwardly toward the inner surface of the lamp envelope 52 as shown at 98 in FIG. 4, the important consideration being that it not contact the inner surface of the lamp envelope. Experiments have shown that it was that pressure point, employed in the prior art lamps, that caused the reject condition known as a stuck seal.

While there have been shown an described what are at present considered the preferred embodiments of the invention, it will be apparent to those skilled in the art that various changes and modifications can be made herein without departing from the scope of the invention as defined by the appended claims.

What is claimed is;

1. An electric lamp comprising:

a sealed lamp envelope including a dome region having an inward projection and a neck region sealed to a lamp stem;

a lamp subassembly located within said lamp envelope, said lamp subassembly including an arc tube for generating light when electrical energy is applied thereto, a generally cylindrical, light-transmissive shroud disposed about said arc tube, a frame comprising a single support rod extending between the dome and neck regions of said lamp envelope along one side only of said subassembly, a dome end of said frame engaging the inward projection of said lamp envelope, means for attaching said arc tube and said shroud to said frame, and a bulb spacer having first and second segments bearing against an inside surface of said lamp envelope in the neck region for positioning said frame relative to said lamp envelope, and having a third segment joining said first and second segments, said third segment being spaced away from the inside surface of said lamp envelope, said frame being attached to said third segment; and electrical leads for coupling electrical energy through said lamp stem to said arc tube, said electrical leads and said lamp stem being electrically isolated from said frame, said lamp subassembly being mechanically supported within said lamp envelope solely by the dome end of said frame, said bulb spacer and said leads.

2. An electric lamp as defined in claim 1 wherein said bulb spacer comprises a generally D-shaped, resilient metal strip having a recess for receiving said support rod of said frame and for locating said support rod of said frame relative to said bulb spacer.

* * * * *